US005699641A

United States Patent [19]

Tinen et al.

[11] Patent Number: 5,699,641

[45] Date of Patent: Dec. 23, 1997

[54] SUSPENSION CEILING WITH INTEGRATED OPENINGS

[75] Inventors: William J. Tinen, Glenview, Ill.; Pawan Singal, North Olmsted; Douglas Hooper, Lakewood, both of Ohio; Alan C. Wendt, Barrington, Ill.

[73] Assignee: USG Interiors, Inc., Chicago, Ill.

[21] Appl. No.: 606,290

[22] Filed: Feb. 23, 1996

[51] Int. Cl.[6] ..... F04B 5/52; E04C 2/42

[52] U.S. Cl. ..... 52/506.07; 52/506.06; 52/664; 248/343

[58] Field of Search ..... 52/506.06, 506.07, 52/506.09, 656.1, 664, 667; 248/343

[56] References Cited

U.S. PATENT DOCUMENTS

| | | | |
|---|---|---|---|
| 3,486,278 | 12/1969 | Woods | 52/81 |
| 3,703,307 | 11/1972 | Curtis | 52/506.07 X |
| 3,710,520 | 1/1973 | Federowicz | 52/506.07 X |
| 3,778,947 | 12/1973 | Sauer | 52/506.07 X |
| 3,995,798 | 12/1976 | Nikolaus et al. | 248/343 X |
| 4,108,563 | 8/1978 | Brown et al. | 403/347 |
| 4,114,327 | 9/1978 | Williams | 52/506.07 X |
| 4,535,580 | 8/1985 | Shirey | 52/506.06 |
| 4,679,375 | 7/1987 | Shirey | 52/777 |
| 4,785,603 | 11/1988 | Platt | 52/506.07 X |
| 5,088,261 | 2/1992 | Mieyal et al. | 52/729 |
| 5,241,799 | 9/1993 | John | 52/506.06 |

FOREIGN PATENT DOCUMENTS

| | | | |
|---|---|---|---|
| 2246377 | 1/1992 | United Kingdom | 52/506.09 |

*Primary Examiner*—Carl D. Friedman
*Assistant Examiner*—Winnie Yip
*Attorney, Agent, or Firm*—Pearne, Gordon, McCoy & Granger LLP

[57] ABSTRACT

A suspended ceiling grid system with an integrated aperture for accessories such as lights, air diffusers and like accessories. The system has an appearance ring of suitable size that forms the aperture and that interconnects with runner elements of corresponding suitable length. The ring is disposed at the geometric center of a grid module and the interconnected runners are arranged to provide support for the ring and related accessory.

18 Claims, 2 Drawing Sheets

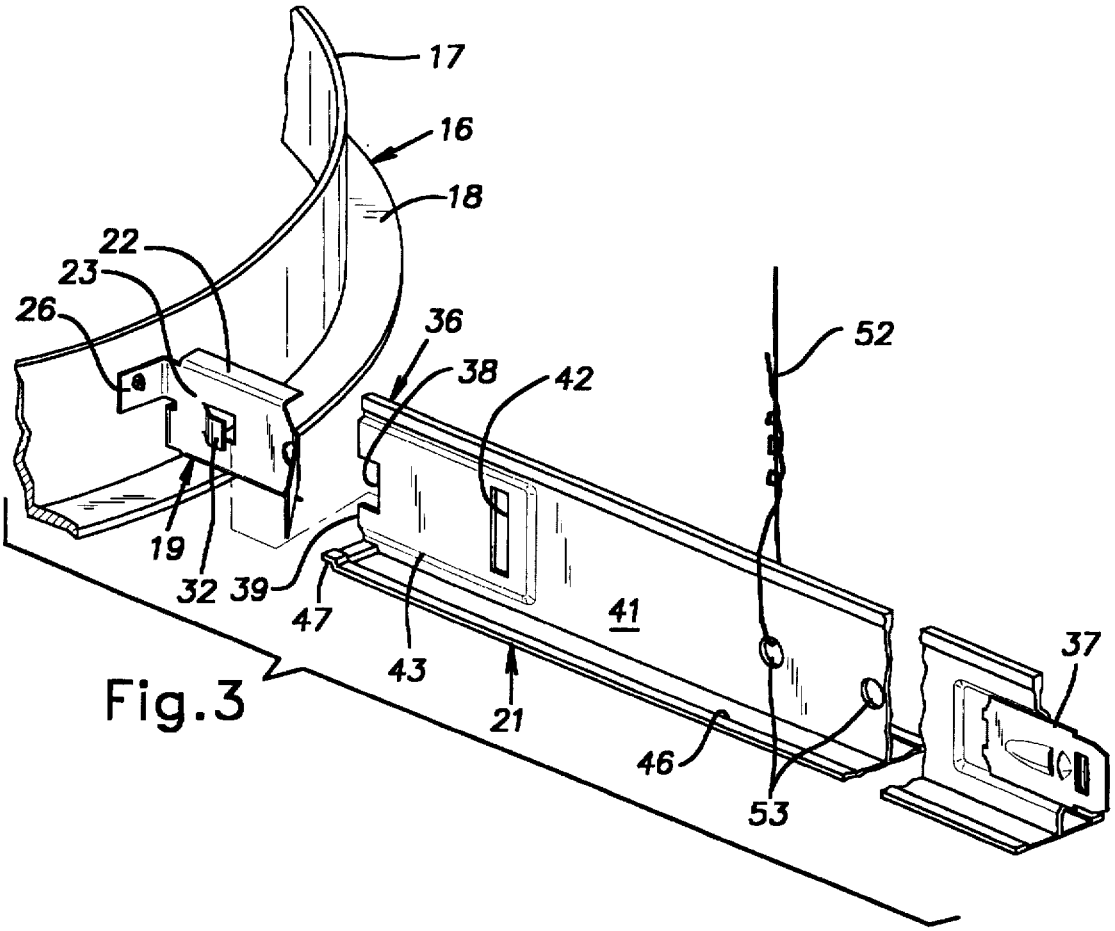
Fig.3
Fig.4
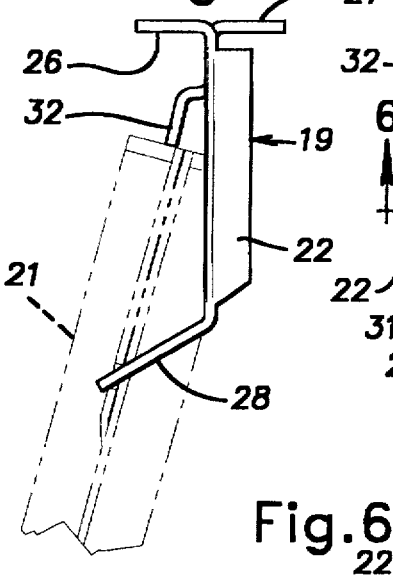
Fig.5
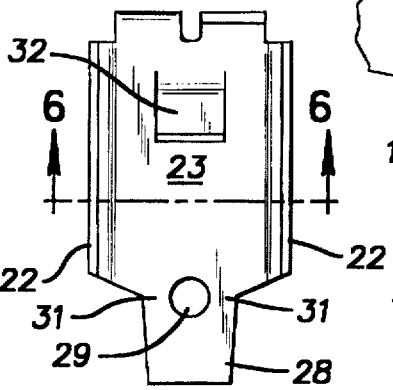
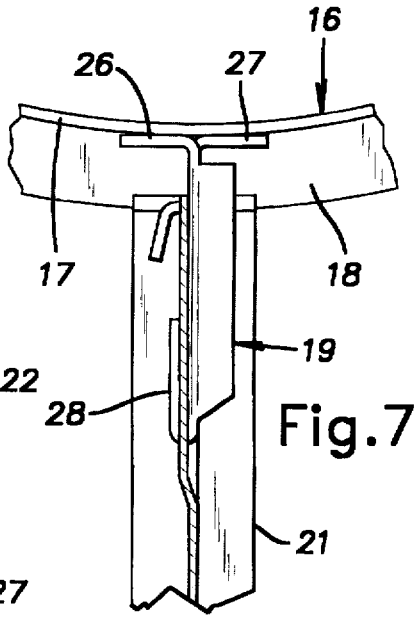
Fig.7
Fig.6
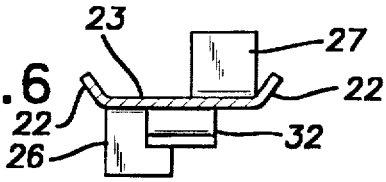

SUSPENSION CEILING WITH INTEGRATED OPENINGS

BACKGROUND OF THE INVENTION

The invention relates to improvements in suspended ceiling constructions and, in particular, to a system for integrating openings in the ceiling grid structure.

PRIOR ART

Frequently, a suspended ceiling supported by a rectangular or orthogonal grid work is arranged with openings, often circular, smaller than the dimensions of a grid module. The openings accommodate lights, air diffusers, speakers, sprinkler heads and other accessories. Typically, the openings are centered in a panel or, at least, are situated in the panel so that the adjacent tee elements of the grid are not interrupted by the opening or aperture. This construction approach has several disadvantages. Among the problems is that the accessory often cannot be installed before the ceiling panel is installed or at least the installation cannot be completed until the panel is put in place. This situation leads to scheduling difficulties where different trades people install the ceiling on the one hand and the accessories on the other hand. Often, panels have to be installed and temporarily removed to be cut with a suitable hole and then be reinstalled. Repeated handling of the panels exposes them to the risk of being soiled, broken and/or misplaced. Another problem is that unless the exact location of the accessories is determined beforehand, the resulting installation work may take on a haphazard appearance because no regular pattern of the holes is produced.

SUMMARY OF THE INVENTION

The invention provides an opening or aperture in a suspended ceiling that is integrated with the grid so that its installation and the installation of a related accessory can be independent of the installation of the adjacent panels. The disclosed aperture forming system involves a prefabricated frame or ring that is assembled at what would otherwise be the common intersection of four cross tees or runners of the grid. The resulting geometry is aesthetically pleasing and inherently produces a regular pattern.

In the preferred embodiment, the aperture is defined by a preformed rigid sheet steel ring. The ring has a cylindrical wall and an integral outwardly extending radial flange. At a 90° spacing, the ring is formed with areas for connecting to the ends of cross tees. The disclosed connecting areas are in the form of radially outwardly extending brackets fixed to the exterior of the cylindrical part of the ring. The brackets are arranged to interlock with the ends of the special cross tees. Advantageously, the brackets on the ring and cross tees are arranged to be field assembled together by the person installing the grid so that these components can originally be compactly and economically packaged and shipped. The bracket design includes a tab that is bent over the associated cross tee to securely lock these elements together for a secure and rigid grid assembly.

A suspended ceiling grid, constructed in accordance with the invention, provides apertures that can be fitted with desired accessories before the panels are laid into the grid. This simplifies the tasks of the various tradesmen and reduces the risk of damage to the panels as exists in conventional methods where the panels are often installed and then temporarily removed either to be cut with an opening or for access to install an accessory.

BRIEF DESCRIPTION OF THE DRAWINGS

FIG. 3 is a fragmentary perspective view of the ring of FIG. 2 and one of four special cross tees prior to assembly;

FIG. 4 is a plan view of a bracket of the ring for connecting an associated cross tee;

FIG. 5 is a side view of the bracket of FIG. 4;

FIG. 6 is cross sectional view of the bracket taken along the plane indicated at 6—6 in FIG. 5; and FIG. 7 is a plan view of the bracket fixed to the ring and with a cross tee assembled thereto.

DESCRIPTION OF THE PREFERRED EMBODIMENT

Figure 1:
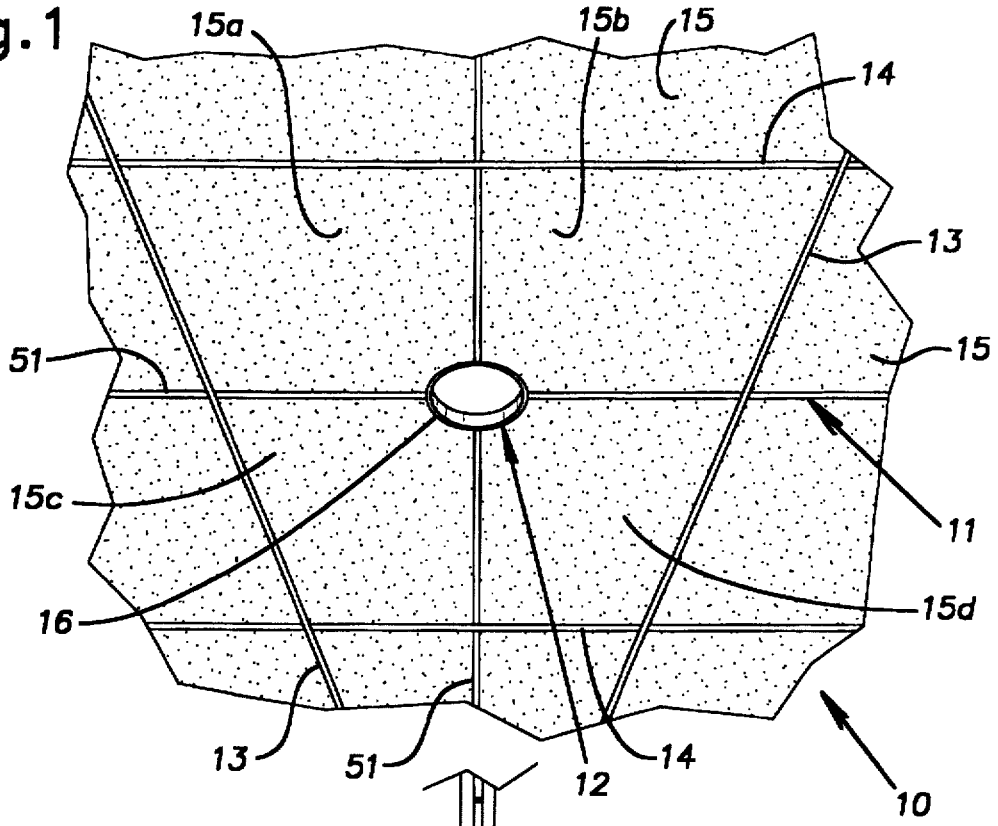
FIG. 1 is a perspective view from below of a suspended ceiling system embodying the invention.
Figure 2:
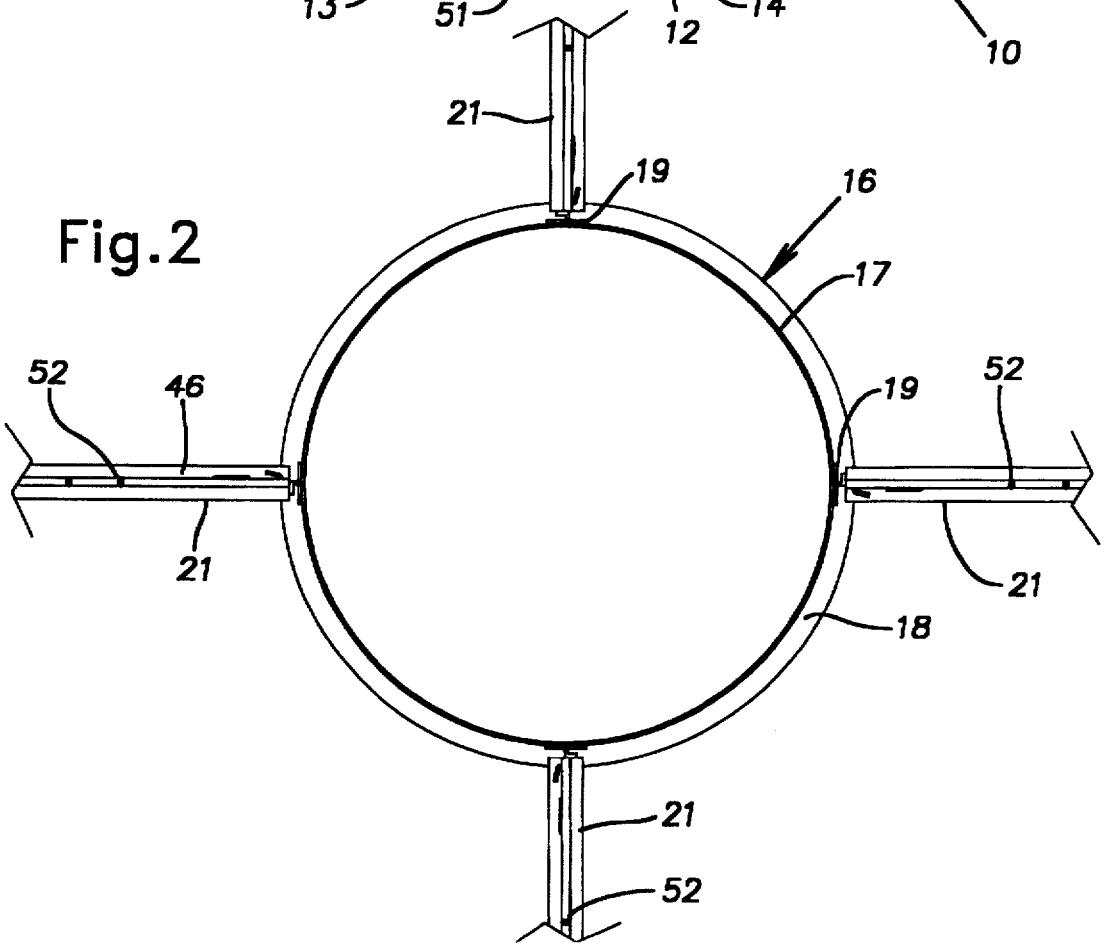
FIG. 2 is a plan view of a portion of a grid and integrated ring in the ceiling system of FIG. 1.

FIG. 1 shows a suspended ceiling system 10 having a rectangular grid 11 and a round accessory opening 12 integrated in the grid. The basic grid elements as is customary in the industry are elongated metal shafts or runners preferably having an inverted T-shape configuration. Ceiling panels 15 are carried by the grid 11. In a known manner, the grid 11 can include parallel main runners or tee elements 13, of a typical working length of 12 feet, and transverse runners or tee elements 14 of a nominal length of 4 feet, for example. In such a case, the long main runners 13 are spaced apart from one another by a distance of 4 feet, the length of the transverse runners 14. The main runners 13 are joined end-to-end by known connector elements to form a ceiling of a desired size in one direction. Similarly, the transverse runners 14 assembled through aligned slots in the main runners 13 are connected end-to-end by suitable connectors such as shown in U.S. Pat. No. 4,108,563 to form a ceiling of desired size in a direction transverse to the main runners 13. The slots into which the transverse runners 14 are assembled are spaced 4 feet apart so that the grid 11 includes 4 foot×4 foot conventional modules. In the illustrated system, the grid 11 is of the narrow faced type disclosed, for example, in U.S. Pat. No. 4,679,375. The main runners or tees 13 and transverse runners or tees 14 are sometimes herein referred to as primary runners or primary tees. At areas within the expanse of the ceiling 10 where it is desired to have a circular opening such as the opening 12 to the plenum above the ceiling, a circular ring 16 is integrated into the grid work 11. While only one ring or aperture frame 16 is illustrated, it will be understood that a plurality of such rings can be distributed throughout the ceiling.

As suggested in FIG. 3, for example, the ring 16 has a cylindrical wall 17 and an integral radially outwardly extending flange 18. The ring 16 is preferably formed of relatively heavy gauge steel such as 18 gauge or of a suitable heavy gauge aluminum sheet and may be made by spinning it from flat stock as is known in the metal working industry.

Ordinarily, the exposed surfaces of the ring, namely the inside of the cylindrical wall 17 and the lower side of the radial flange 18, at least, are painted to match the color and finish of the exposed flange surfaces of the associated tee elements of the grid not concealed by the panels 15. The radial width of the flange 18 is preferably at least as wide as one-half of the width of the flange of the tees 13, 14 of the grid 11 so that an edge of a panel 15*a*–*d* cut with a circular segment to fit around the cylindrical wall 17 will be readily concealed for a good appearance.

At four equally spaced locations, i.e. separated by 90°, on the outer periphery of the cylindrical wall 17, there are situated elements 19 for connecting a corresponding set of special cross tees 21. In the illustrated example, the connector elements 19 are in the form of generally radially extending brackets. With reference particularly to FIGS. 4 through 7, the brackets 19 are identical integral steel stampings. Small reinforcing flanges 22 extend longitudinally on one side of a main body 23 of the bracket 19 at its top and bottom. A pair of tabs 26, 27 are spot-welded to the ring wall 17 to permanently attach the bracket 19 to the ring 16 while leaving the interior surface of the wall 17 substantially uninterrupted. At its free or distal end, the bracket 19 includes a bendable tab 28. A hole 29 at the junction of the tab 28 and the main body 23 ensures that the tab will bend at local points 31 bridging between the tab and the body. A fixed tab 32 is stamped out of the plane of the body 23 adjacent the mounting tabs 26, 27.

A cross tee 21, typical of four identical cross tees, is illustrated in a fragmentary perspective view in FIG. 3. The cross tee 21 has one end 36 adapted to connect with one of the ring brackets 19 and an opposite end with a connector 37 of generally conventional construction like that shown in U.S. Pat. No. 4,108,563, or as shown in U.S. patent application Ser. No. 08/248,761, for example. A leading edge 39 of the tee end 36 adjacent the ring 16 includes a rectangular vertical notch 38 in a web 41 of the cross tee 21. The cross tee 21 like the runners 13 and 14 is an elongated shaft-like element having an inverted T-shaped cross section. The cross tees 21 are sometimes herein referred to secondary tees or secondary runners. The end 36 also includes a rectangular vertical hole 42 in the web 41 spaced longitudinally rearwardly from the notch 38 at the leading edge 39. In a rectangular area 43 surrounding the notch 38 and hole 42, the web 41 is embossed so that it is laterally offset from the plane of the remainder of the web 41 and when assembled on the bracket 19 allows the bracket and main part of the web to be substantially coplanar. A flange 46 of the tee 21 is raised locally at 47 so that when the tee 21 is assembled on the ring 16, the remainder of the flange is coplanar with the ring flange 18.

The tee 21 is assembled on a respective one of the brackets 19 by guiding the leading edge notch 38 into coupling engagement with the fixed bracket tab 32 while the tee is oblique with respect to the radial plane of the bracket and the free end of the bendable tab 28 is inserted in the rectangular hole 42. This assembly step is depicted in FIG. 4 where the tee 21 is shown in phantom. From this step, the tee 21 is swung into alignment with the bracket 19 such that the longitudinal direction of the tee is radial to the ring 16 and the embossed area 43 of the web 41 is in abutting contact with a face of the bracket body 23. Thereafter, the tab 28 is bent towards the ring 16 until it is substantially completely reversed in relation to the main bracket body 23 and is substantially flat against the tee web 41 as shown in FIG. 7. The relatively small size of the bridge elements or bend points 31 allows this to be accomplished manually without excessive force thereby enabling an installer to use thumb pressure to perform this step without tools, if desired. The tab 32 and notch 38, are proportioned to produce a close fit of the ring and tee assembly in a module, measured lengthwise of the cross tees 21 and proper height of the ring 16 relative to the tees. Additionally, the design and the relative dimensions of the interlock between the notch 38 and tab 32 and between the hole 42 and tab 28 produces a connection which strongly resists any significant hinge-like motion about an imaginary horizontal axis and/or an imaginary vertical axis between the tee 21 and the ring 16.

The ring 16 and cross tees or secondary runners 21 are dimensioned so that the nominal length of two of such tees and the diameter of the ring added together is substantially equal to the module size of the grid formed by the primary runners 13 and 14. Stated in another way, the nominal length of a cross tee 21 and the radius of the ring 16, together, is substantially equal to one-half of the module size. The ring 16 and a set of four cross tees 21 are advantageously marketed in a package as an unassembled kit. For economy, more than one kit, each comprising a ring 16 and four cross tees 21, can be packaged in the same box when shipped by the manufacturer. If desired, the panels 15*a, b, c* and d adjacent the ring 16 can be supplied from the manufacturer in sets of four units each with a circular segment precut from a different corner. This can ensure a high quality appearance around the ring 16 particularly when the panels 15 are rabbeted on their edges to present a so-called reveal edge or shadow line.

The person installing the ceiling grid 11 can assemble each of the four cross tees 21 on the ring 16 in the manner described to form a spider-like configuration and then can assemble this subassembly into the grid module formed by the main tees 13 and transverse tees 14. The various grid elements have enough elasticity and freedom of movement to readily permit this final assembly. The ends of the tees 21 remote from the ring 16 are inserted into slots in the primary runners 13, 14 customarily situated at mid-length of the module. The connectors 37 at these free ends preferably are of the type that produce a connecter-to-connector interlock with opposite tees 51 as is known in the art. Once the tees 21 are connected to the grid through slots in the primary tees or runners 13, 14, wires 52 or other suspension elements are tied to several, preferably at least two, of the tees 21 to support the ring 16 in the plane of the grid 11 and any accessory carried by the ring in a stable manner. Holes 53 in the tees 21 are provided for this purpose; preferably these holes 53 are substantially in the range of between 4" and 6" from the end 36 of the tee.

It will be understood that the ring 16 may be manufactured in several nominal diameter sizes. For example, the inside diameter of the ring 16 can be supplied to complement light fixture sizes of nominally 4, 6 and 8 inches. Typically, the inside diameter of the ring 16 for a 4 inch nominal light fixture will have an inside diameter of about 5.2 to 5.5 inch diameter, for example. Similarly, by way of example, for a 6 inch light fixture, the inside diameter of the ring 16 can be about 6.7 inches and for an 8 inch light fixture, the inside diameter can be about 8.4 inch. Where the ring 16 is used for providing access from the plenum for sprinkler heads, the inside diameter of the ring can be about 2.7 inches. Of course, the ring can be provided in other sizes to suit specific applications. In addition to providing a mounting or clearance structure for lights and sprinklers, a ring 16 can be used to mount speakers, air diffusers, or vents, and other accessories. These accessories can be conveniently installed once the grid 11 with the rings 16 is in place by a tradesman other than the grid installer before the ceiling panels 15 are set in place. It will be understood that in the expanse of a particular ceiling a ring can be situated in any one module, customarily a 4 foot×4 foot module, as desired and such rings can be of different diameters.

The invention has been described in relation to a circular ring framing an aperture at the center of a standard module of a suspended ceiling grid and being assembled with a set of four cross tees of equal length. Aspects of the invention have application to other arrangements. The apertures can have other configurations besides circular such as square or rectangular. A frame, square, rectangular, or of other shape, substituted for the ring 16 can be made with its perimeter including a vertical wall corresponding to the wall 17 and a horizontal flange corresponding to the flange 18. Such an aperture frame, ideally, is a rigid prefabricated structure and, like the ring 16, is preferably made of heavy gauge steel or aluminum. The aperture frame, whether round or otherwise, can be supported by fewer than four tees or runners. For example, the aperture frame can be carried by two opposed colinear tees or runners. The supporting tees can be of unequal length such as can exist, for instance, with an aperture frame in the center of a 2 foot×4 foot grid module. Additionally, the aperture frame, if desired, can be situated off center in a rectangular or square grid module and the supporting tees or runners can be dimensioned appropriately. It is contemplated the aperture frame can be assembled at what would otherwise be the intersection of a main runner and two transverse runners provided that appropriate connecting structures are afforded on the ends of these tees or runners. The disclosed invention is adaptable to grid systems other than the standard 4 foot×4 foot module commonly used in the United States of America.

It should be evident that this disclosure is by way of example and that various changes other than those discussed herein may be made by adding, modifying or eliminating details without departing from the fair scope of the teaching contained in this disclosure. The invention is therefore not limited to particular details of this disclosure except to the extent that the following claims are necessarily so limited.

We claim:

1. A planar suspended ceiling grid comprising a first pair of spaced parallel primary unitary runners extending in a first direction in a horizontal plane, a second pair of spaced parallel primary unitary runners extending in a second direction in said horizontal plane perpendicular to the first direction between the first pair of runners and being connected thereto, the spacing between the first pair of primary runners and the spacing between the second pair of primary runners being such that the first and second pair of primary runners form a rectangular module pattern, a circular ring in the geometric center of the rectangular module in said horizontal plane and including a cylindrical wall and a circular flange at a lower visible face extending radially outwardly from the cylindrical wall, a set of four secondary runners in said horizontal plane, each of said secondary runners being attached at one end to the exterior of the cylindrical wall of the ring and at an opposite end to a center of a respective length of one of said primary runners forming the rectangular module, the secondary runners being perpendicular to the primary runners to which they are connected, the ring being vertically supported by the secondary runners through their mutual interconnections, the interconnections being arranged such that said one end of each of the runners adjacent the ring overlie and are concealed by the flange when viewed from below.

2. A suspended ceiling grid as set forth in claim 1, wherein said circular flange is at the lower end of the cylindrical wall.

3. A suspended ceiling grid as set forth in claim 2, wherein said secondary runners have ends with flanges overlying the flange of said ring.

4. A suspended ceiling grid as set forth in claim 1, including substantially identical bracket elements on the outer periphery of the ring spaced at 90° intervals for connecting with respective ends of the secondary runners.

5. A suspended ceiling grid as set forth in claim 4, wherein said ring has a cylindrical interior surface which is substantially uninterrupted by said bracket elements.

6. A suspended ceiling grid as set forth in claim 4, wherein said bracket elements each include a bendable tab that interlocks with a formation on the end of a respective secondary runner.

7. A suspended ceiling grid as set forth in claim 1, wherein said primary and secondary runners have inverted tee configurations.

8. A method of constructing a planar grid for a suspended ceiling incorporating an aperture communicating with the plenum above the ceiling comprising suspending a grid of interlocking generally orthogonal primary runners to form an array of rectangular modules, assembling a set of four secondary runners to a periphery of a ring with proximal ends of the secondary runners being connected to an outer surface of a cylindrical wall of the ring at 90° spacing and with the ring including a circular flange visible from below the ceiling grid at its lower face extending radially from the cylindrical wall and distal ends connected to the primary runners at the mid-length of each side of a common module, the secondary runners being connected to the ring in a manner that holds the primary runners, secondary runners and ring in a common plane, that is adequate to allow the ring and any intended accessories carried by the ring to be supported exclusively by the secondary runners, and that results in the proximal ends being concealed by the flange when viewed from below the ceiling grid.

9. A method as set forth in claim 8, wherein at least two of the four secondary runners are supported by depending wires attached thereto through holes in the secondary runners adjacent the ring.

10. A kit for providing an aperture in a suspended ceiling comprising a ring having an inside dimension generally equal to the desired diameter of the aperture and including a generally vertical cylindrical wall and a peripheral flange extending horizontally from the wall, and a set of four essentially identical cross tees, a working length of the cross tees being substantially equal to two feet minus one-half the dimension of the ring, the ring having four predetermined locations equally spaced on an outer periphery of the vertical wall for separately connecting to proximal ends of the cross tees in a manner wherein, in assembly, the proximal ends are concealed by the flange when the assembly is viewed from below the ceiling, the cross tees having connectors on their distal ends adapted for coupling with slots in main tees and transverse tees, wherein the transverse tees are perpendicular to and interconnected with the main tees to form a four foot by four foot sided module of a ceiling grid such that said cross tees connect at the mid-points of the sides of such module.

11. A kit as set forth in claim 10, wherein the cross tees are provided with holes adjacent their proximal ends for securing suspension wires thereto.

12. A kit as set forth in claim 10, further including brackets being permanently fixed to the ring at said predetermined locations.

13. A kit as set forth in claim 12, wherein the brackets each have a main body lying in a plane radial to the center of the ring.

14. A kit as set forth in claim 13, wherein each bracket and proximal tee end have formations that mutually engage when interconnected to resist hinge-like relative movement about imaginary horizontal and vertical axis between the connected cross tee and the ring.

15. A kit as set forth in claim 10, wherein said circular flange extends radially outwardly from a lower end of the cylindrical wall.

16. A kit as set forth in claim 12, wherein the brackets and cross tees are configured to allow the edge of the proximal end of each tee to overlie and be concealed by the ring flange when the grid is viewed from below.

17. A planar suspended ceiling grid comprising a plurality of first unitary runners arranged in spaced parallel rows extending in a first direction in a horizontal plane and a plurality of second unitary runners arranged in spaced parallel rows extending in a second direction in said horizontal plane perpendicular to the first direction, the first and second runners intersecting one another to divide a ceiling area into a repeating pattern of orthogonal shapes, a rigid prefabricated aperture frame having sidewall areas defining a closed boundary adapted to define an aperture in the ceiling that is smaller than the orthogonal shapes formed by said runners, at least two of the runners being colinear and being connected to opposite locations on outer sidewall areas of the aperture frame and supporting the aperture frame in said plane and in the geometric center of the orthogonal shape, formed by said runners, in which the aperture frame exists, the connection between said at least two runners and the aperture frame being adequate to provide the sole support from the said at least two runners for the aperture frame and any expected accessories to be carried by it, the aperture frame including a flange relatively thin and visible from below the ceiling grid, the runners connected to the outer sidewall areas of the aperture frame having their ends overlying and being concealed by said flange when viewed from below the ceiling grid.

18. A suspended ceiling grid as set forth in claim 17, wherein at least two of the runners connected to the frame are supported by depending wires attached thereto through holes in such runner adjacent the frame.

* * * * *